US007980389B1

(12) United States Patent
Lee

(10) Patent No.: US 7,980,389 B1
(45) Date of Patent: Jul. 19, 2011

(54) AUTOMOTIVE SEAT PACKAGING APPARATUS

(75) Inventor: Yohan E. Lee, Hilliard, OH (US)

(73) Assignee: Honda Motor Co., Ltd., Tokyo (JP)

( * ) Notice: Subject to any disclaimer, the term of this patent is extended or adjusted under 35 U.S.C. 154(b) by 36 days.

(21) Appl. No.: 12/490,467

(22) Filed: Jun. 24, 2009

(51) Int. Cl.
*B65D 19/44* (2006.01)

(52) U.S. Cl. ..... 206/386; 206/821; 108/55.5

(58) Field of Classification Search ..... 206/326, 206/335, 386, 588–593, 595–600, 821; 108/51.11–56.3
See application file for complete search history.

(56) References Cited

U.S. PATENT DOCUMENTS

| | | | | |
|---|---|---|---|---|
| 3,651,934 | A * | 3/1972 | Roberts et al. | 206/326 |
| 4,603,780 | A | 8/1986 | Duffy et al. | |
| 4,709,817 | A | 12/1987 | Keady et al. | |
| 4,972,954 | A | 11/1990 | Dickie | |
| 5,101,964 | A | 4/1992 | Westphal | |
| 5,413,216 | A | 5/1995 | Timmins | |
| 5,497,708 | A * | 3/1996 | Jeruzal | 108/54.1 |
| 5,529,185 | A | 6/1996 | Alspach et al. | |
| 5,575,389 | A | 11/1996 | Alspach et al. | |
| 7,077,067 | B2 | 7/2006 | Bodde et al. | |

* cited by examiner

*Primary Examiner* — Bryon P Gehman
(74) *Attorney, Agent, or Firm* — Rankin Hill & Clark LLP

(57) ABSTRACT

A seat extension tray is described that serves to protect a vehicle seat assembly during shipment, such as for example to an automobile assembly operation. The seat extension tray has a unique configuration adapted to matingly engage a seating surface of the seat assembly. The seat extension tray has a length greater than the maximum width of the seat assembly so that upon securing the tray to the seat assembly, the ends of the tray extend laterally outward beyond the sides of the seat assembly.

18 Claims, 5 Drawing Sheets

AUTOMOTIVE SEAT PACKAGING APPARATUS

FIELD OF THE INVENTION

The present invention relates to vehicle seat assemblies and protecting such assemblies during shipment.

BACKGROUND OF THE INVENTION

Mass production of a product from its various components is well known, especially within the automotive industry. Typically, many of the components are prefabricated at one location and transported to another site for final assembly into the finished product. For an automobile seat, it is common practice for the seat to be completely prefabricated at one location, mounted on a supporting base such as a pallet, transported to the final assembly site, subsequently off-loaded from a shipping vehicle, and transferred to the final assembly line where the seat is removed from the support base and assembled into the final vehicle.

A current trend in the automotive industry is to increase passenger room within the vehicle cabin. This is particularly of interest in the luxury vehicle market. Increased cabin space is typically accompanied by wider seats which in turn promote driver and passenger comfort.

An undesirable consequence of wider vehicle seats is that the overall width of a seat assembly may exceed the width of its shipping supporting base or pallet. As will be appreciated, seat assembly ends or sides that extend beyond the width of a pallet are prone to damage from impact or contact with a variety of surfaces and structures that may be encountered during shipping. This is particularly so if the seat ends are exposed or otherwise unprotected.

A solution to this problem is to increase the width of the shipping supporting base or pallet. By increasing the width of the supporting base such that it is greater than the overall width of the seat assembly to be transported thereon, the potential for damage to the ends of the seat assembly can be significantly reduced. During shipping or transport, seat assemblies and corresponding pallets are frequently closely arranged to one another. As a consequence, the edges of adjacent pallets are typically in contact with one another. So long as the seats do not extend beyond the pallet edges, the pallets themselves provide protective spacing between neighboring seat assemblies.

However, increasing the width of pallets impacts numerous aspects of the shipment process and shipping equipment. For example, increasing pallet width would alter the footprint of the pallet and thus likely impact many existing conveyor systems. As will be appreciated, modification of conveyor systems would be significant and costly. Moreover, replacing conventional pallets with larger or wider pallets would result in further significant costs.

Accordingly, a need exists for protecting vehicle seat assemblies during shipment, and particularly protecting such seat assemblies that have a width that exceeds the width of a support base or pallet upon which the seats are disposed during shipping.

Related to this need, it would also be desirable that such protection for seat assemblies be cost-effective and relatively inexpensive. Providing protective assemblies over seat ends is undesirable due to the added cost of such assemblies, the labor associated with covering seat ends with those assemblies, and removing the protective assemblies from seat ends.

SUMMARY OF THE INVENTION

The difficulties and drawbacks associated with previous systems and shipment methods are overcome in the present method, assembly, and device for a seat extension tray.

In a first aspect, the present invention provides an assembly of vehicle seat components adapted for shipping. The shipping assembly comprises a seat pallet base, the seat pallet base defining a width dimension. The shipping assembly also comprises a seat assembly releasably secured to the seat pallet base. The seat assembly has a width dimension and defines a base disposed on the seat pallet base and a seating surface supported by the base. The shipping assembly further comprises a seat extension tray disposed on the seat assembly. The seat extension tray defines a first end and a second end opposite from the first end, and a length dimension extending between the first end and the second end of the seat extension tray. The length dimension of the seat extension tray is greater than the width dimension of the seat assembly.

In yet another aspect, the present invention provides a seat extension tray adapted for protecting a vehicle seat assembly during shipment. The seat extension tray defines a first end, a second end opposite the first end, a length dimension extending between the first end and the second end of the seat extension tray, and a first face extending between the first end and the second end. The first face defines at least one recessed region. The at least one recessed region is configured to receive and matingly contact the vehicle seat assembly. The length dimension of the seat extension tray is greater than the width of the vehicle seat assembly.

In yet another aspect, the present invention provides a method of protecting a vehicle seat assembly defining a seating surface, in which the seat assembly is releasably secured to a seat pallet base. The method comprises providing a seat extension tray defining a first end, a second end opposite from the first end, and a length dimension extending between the first end and the second end, the seat extension tray having a length dimension greater than the width of the seat assembly. The seat extension tray defines a face adapted to matingly receive and contact the seating surface of the seat assembly. The method also comprises positioning and contacting the face of the seat extension tray with the seating surface of the vehicle seat assembly such that the first end of the seat extension tray extends laterally beyond a first side of the seat assembly and the second end of the seat extension tray extends laterally beyond a second side of the seat assembly.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Figure 1:
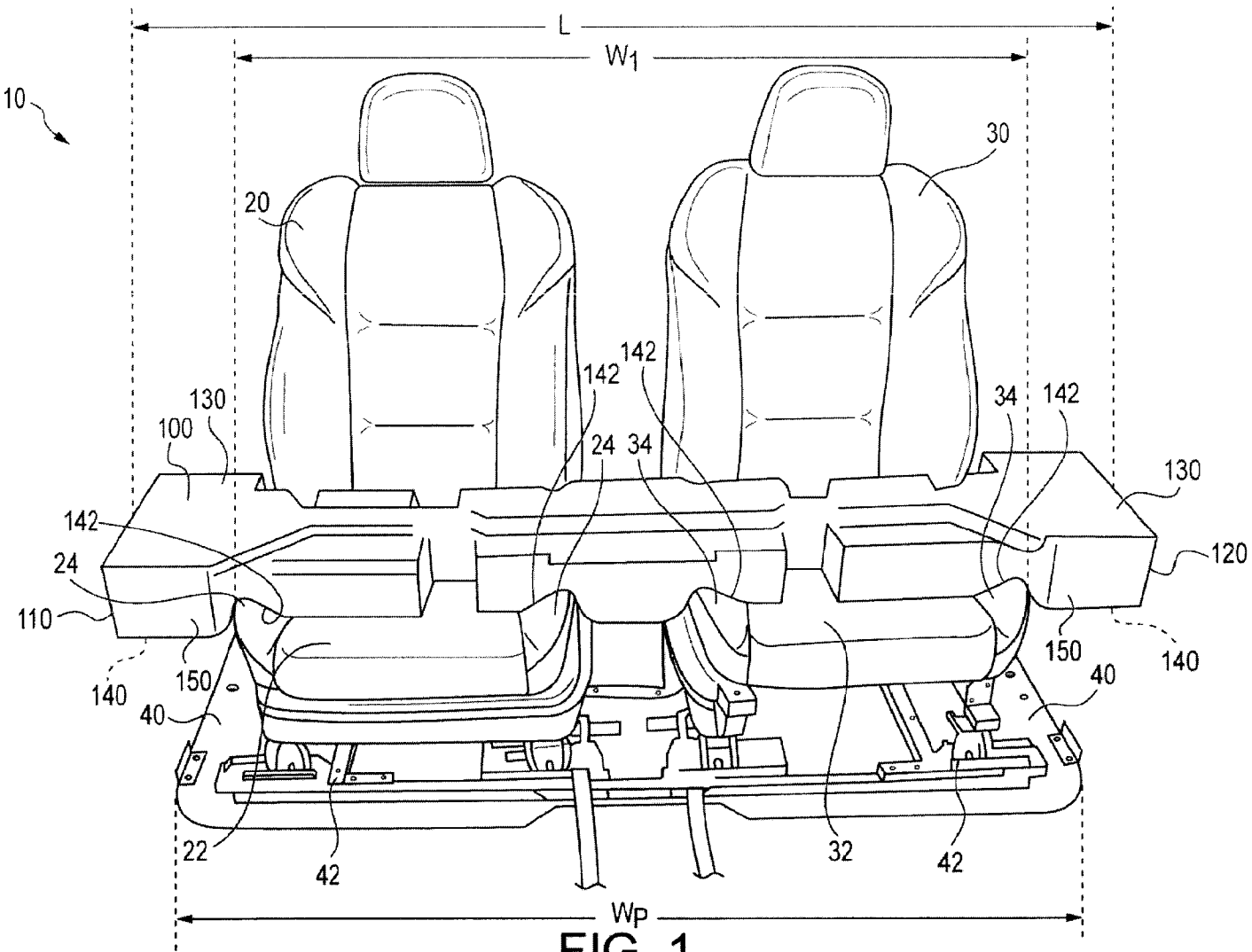
FIG. 1 is an illustration of a representative seat assembly and seat extension tray disposed on a seat pallet base in accordance with a preferred embodiment of the present invention. The seat extension tray is positioned such that its top face and forward face are shown.
Figure 2:
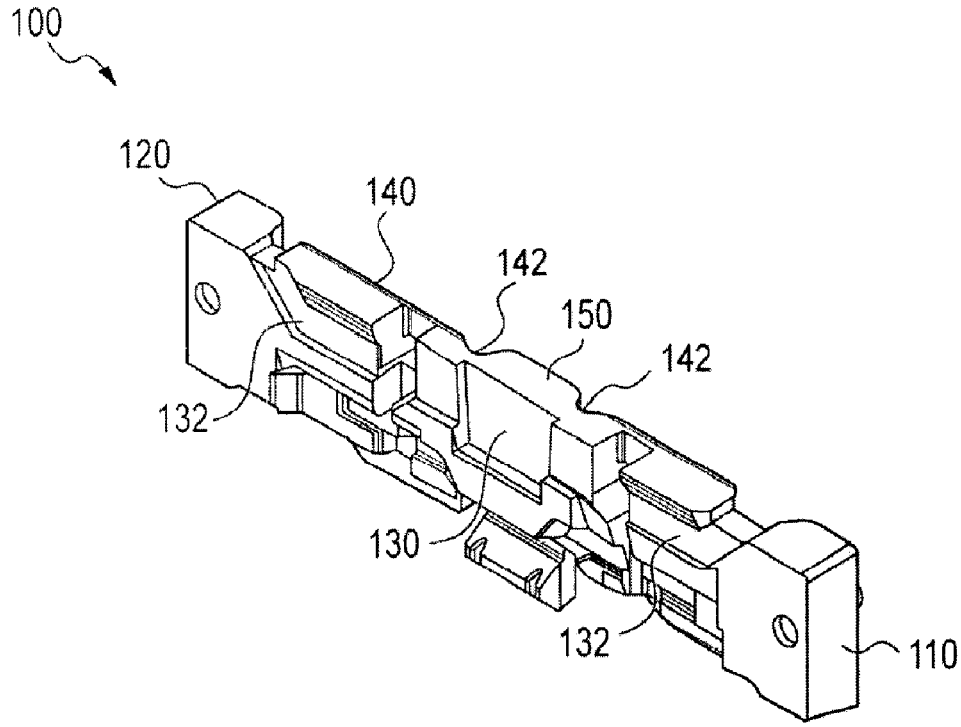
FIG. 2 is a perspective view of a preferred embodiment seat extension tray in accordance with the present invention, again illustrating the top face and the forward face of the seat extension tray.
Figure 3:
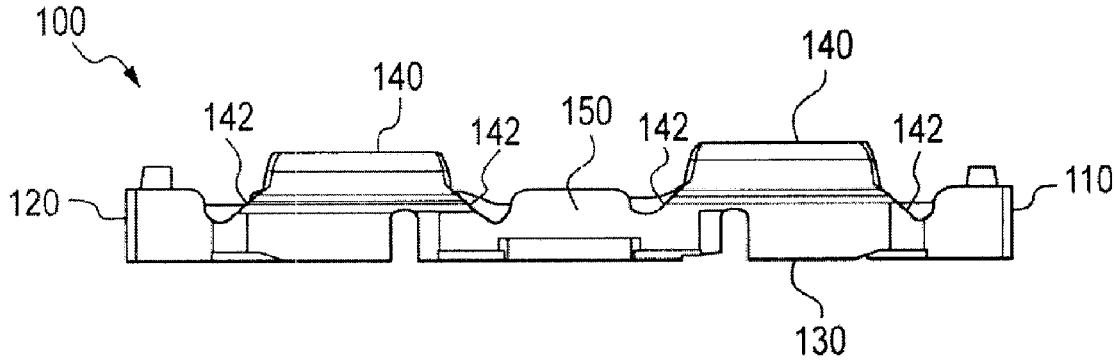
FIG. 3 is a front planar view of the tray illustrated in FIG. 2 showing the forward face of the tray.
Figure 4:
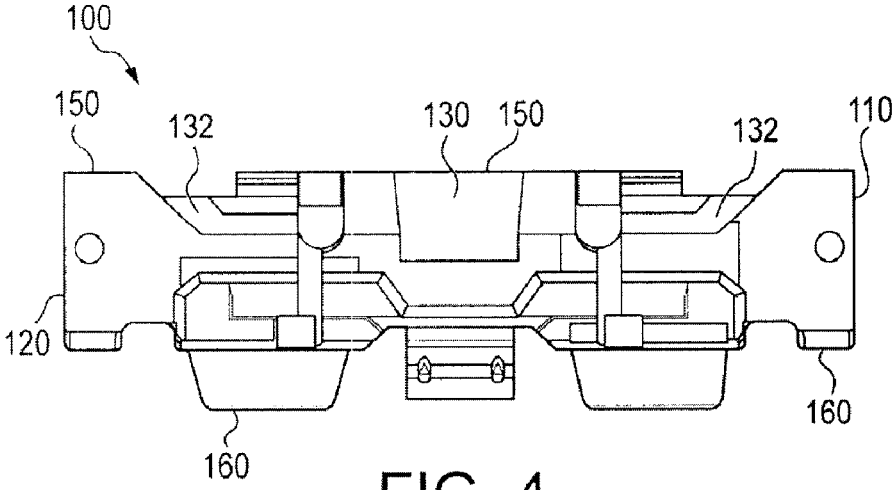
FIG. 4 is a top planar view of the tray illustrated in FIG. 2 showing the top face of the tray.
Figure 5:
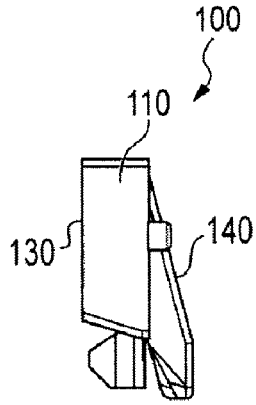
FIG. 5 is an end view of the tray illustrated in FIG. 2.
Figure 6:
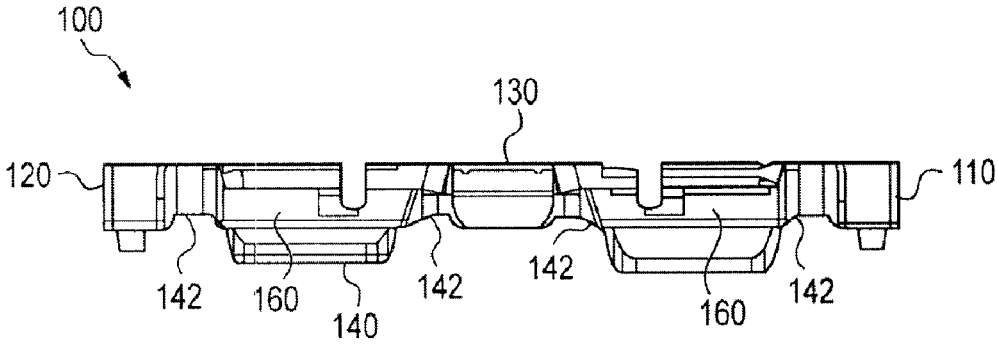
FIG. 6 is a rear planar view of the tray depicted in FIG. 2.

As described in greater detail herein, the present invention provides a seat extension tray that when incorporated in a seat shipping assembly, protects the assembly and in particular, lateral side regions of the seats which are typically exposed. The invention also relates to a seat shipping assembly including the extension tray. And, the present invention further relates to methods of shipping or otherwise transporting vehicular seating components by use of the seat extension tray.

Seat Extension Tray

In accordance with the present invention, a seat extension tray is provided that when incorporated in a seat shipping assembly, protects the assembly and in particular, protects one or more end regions of seating components of the assembly. As described in greater detail herein, typically the seat extension tray is positioned or otherwise disposed upon the seats of the seat assembly. Preferably, the seat extension tray is a longitudinal member defining two oppositely directed end faces. The cross sectional shape of the seat extension tray may be uniform or vary at different locations along the length of the tray. Preferably, the seat extension tray defines an upwardly directed face and a downwardly directed face. As described in greater detail herein, it is preferred that each of these faces exhibits a particular configuration.

The seat extension tray provides protection for one or more seat assemblies or seat components by extending or projecting outward beyond an outermost region or surface of the respective seat in a seat shipping assembly. Accordingly, a feature of the preferred embodiment seat extension tray is that the tray have a length that is greater than (i) the maximum width of the seat or seating assembly with which the tray is utilized, and (ii) the maximum width of the seat pallet base upon which the seat or seating assembly is (or will be) disposed. The present invention includes seat extension trays having lengths greater than only (i) or (ii). However, it is preferred that the extension tray have a length greater than both (i) and (ii).

The difference between the length of the seat extension tray and the greater of (i) and (ii) may be as small as only a few millimeters. However, it is preferred that this difference be at least 10 mm. As previously explained, due to trends in the automotive industry, seat widths may in many instances be greater than the width of the seat pallet base. Therefore, in accordance with the present invention, it is preferred that the length of the seat extension tray be greater than the maximum width of the seat assembly, and preferably at least 10 mm greater.

Seat Shipping Assembly Utilizing the Seat Extension Tray

As is well known in the modern assembly of vehicles, prefabricated seats or collections of seats are typically shipped to an assembly facility for installation in a vehicle. The seats are releasably secured to a seat pallet base as known in the art. The seat pallet base may include adjustable provisions for releasably attaching the seat to the pallet base, and in certain applications may include radio frequency identification (RFID) tags to enable tracking and monitoring of the assembly during shipping.

Depending upon the size, shape and configuration of the seat(s), a single seat or multiple seats may be secured to a seat pallet base. Typically, the base of each seat is placed in contact with the pallet base such that the seat(s) are oriented in their upright as-installed position. The seat extension tray of the present invention is preferably incorporated in a seat shipping assembly by positioning the extension tray on the upwardly directed seating surface of the seat(s). This configuration is preferred rather than positioning the tray directly on the seat pallet. Disposing the tray directly on the pallet could potentially result in interference with conveyor equipment. Instead, by elevating the tray above the surface of the pallet, such potential for interference can be avoided or at least significantly reduced. Most preferably, the tray is symmetrically positioned with respect to the seat(s) such that the ends of the extension tray extend an equal distance beyond each respective side of the seat or seating assembly. As previously noted, it is preferred that the length of the extension tray be at least 10 mm greater than the width of the seat or seating assembly. Thus, upon symmetrically positioning the extension tray upon a seat or seating assembly, each end of the tray extends an equal distance of at least 5 mm on each side of the seat or seating assembly.

In certain applications, it may be desirable to include additional seats or seating assemblies in a seat shipping assembly. These additional seats are in addition to those that are releasably secured to the seat pallet base. Typically, such additional seats are disposed on the upwardly directed seating surface of the seat(s) secured to the pallet base.

In this situation, when utilizing the seat extension tray, the additional seat(s) can be positioned directly on the tray. Thus, the tray is disposed between the seats secured to the pallet base and the additional seats disposed on the tray. The resulting collection of seats and extension tray can then be further secured to the seat pallet base by one or more attachment members such as straps, ties or cords.

Engagement Regions of the Seat Extension Tray

As noted, preferably, the seat extension tray defines two generally opposite faces, an upwardly directed face and a downwardly directed face. The references to "upwardly" and "downwardly" refer to the seat extension tray during its use and incorporation in a seat shipping assembly. Preferably, the extension tray defines a downwardly directed face that exhibits a configuration that corresponds to the shape and contour of the upwardly directed seating surface(s) of the seat(s) upon which the extension tray is disposed. Generally, the downwardly directed face defines one or more recessed receiving regions that matingly engage, contact, and/or receive corresponding upwardly directed portions of the seat(s). This aspect is described in greater detail in conjunction with various figures addressed herein.

It is also preferred in certain applications that the upwardly directed face of the seat extension tray defines one or more recessed receiving regions that matingly engage, contact, and/or receive corresponding downwardly directed portions of seat(s), such as additional seats that may be included in a seat shipping assembly. This aspect is also described in greater detail in conjunction with various figures herein.

Materials for the Seat Extension Tray

Preferably, the seat extension tray is formed from a deformable, resilient, material having sufficient rigidity to maintain its shape and yet deformable such that upon application of a force, the tray may deform and then return to its original shape and configuration. Preferred materials for the seat extension tray include expanded or foamed polymeric materials as known in the art. The foamed materials may include open celled configurations, closed cell configurations, and combinations thereof.

A wide array of foamed polymeric materials may be used for the seat extension tray. Examples include but are not limited to, polypropylene foam, polyethylene foam, polyurethane foam, and crosslinked and non-crosslinked versions and combinations thereof. Preferably, the foamed material is an expanded polypropylene foam. Polypropylene foam is a tough, resilient, and lightweight closed cell material that is moisture and chemical resistant and can be used across a wide range of temperatures. Polypropylene foam is typically used for cushion packaging, and dunnage applications (blocking and bracing) as well as numerous other applications. Polypropylene foam is commercially available from suppliers such as Kaneka Corporation of Osaka, Japan and Dow Chemical Corporation of Midland, Mich., USA. Additional details as to expanded polypropylene foams and their manufacture, are provided in U.S. Pat. Nos. 4,882,108; 4,940,736; 5,348,795; and 5,567,742.

Methods of Protecting Seat Assemblies

In accordance with the present invention, vehicle seat assemblies are protected by utilizing the seat extension tray. Generally, these methods involve providing a seat extension tray that defines a first end, a second end opposite from the first end, and a length dimension extending between the first end and the second end. The seat extension tray has a length dimension greater than the width of the seat assembly. The seat extension tray defines a face adapted to matingly receive and contact the seating surface of the seat assembly. The methods also involve positioning and contacting the face of the seat extension tray with the seating surface of the vehicle seat assembly such that the first end of the seat extension tray extends laterally beyond a first side of the seat assembly and the second end of the seat extension tray extends laterally beyond a second side of the seat assembly. Typically, the length of the seat extension tray is greater than the width of the seat pallet base. As noted, preferably the length of the seat extension tray is at least 10 mm greater than the width of the seat assembly. In addition, it is also preferred that the face of the seat extension tray defines at least one recessed receiving region. The tray is positioned and contacted with the seating surface of the vehicle seat assembly such that at least a portion of the seat assembly is matingly contacting the at least one recessed receiving region defined along the face of the seat extension tray.

It is also preferred that the vehicle seat assembly which is releasably secured to the seat pallet base includes a first seat assembly and the face of the seat extension tray is a first face. The seat extension tray can further define a second face opposite from the first face, the second face defining at least one recessed receiving region. In such a situation, the method further comprises positioning and disposing a second seat assembly on the seat extension tray such that at least a portion of the second seat assembly is matingly contacting the at least one recessed receiving region defined along the second face of the seat extension tray.

FIG. 1 illustrates a preferred embodiment seat shipping assembly 10 in accordance with the present invention. The seat shipping assembly 10 comprises one or more seats, such as for example a front driver seat 20 and a front passenger seat 30 both of which are releasably secured along their bases to a seat pallet base (hereinafter pallet) 40. The seats 20, 30 are releasably attached to the pallet 40 by one or more affixment assemblies 42 as known in the art. The seat shipping assembly 10 also comprises a seat extension device, such as for example, a preferred embodiment seat extension tray 100. The seat extension tray 100 is preferably disposed directly on the front driver seat 20 and the front passenger seat 30. Preferably, the tray 100 contacts a front driver seating surface 22 and a front passenger seating surface 32. The preferred positional relationship between the tray 100 and the seats 20, 30 is described in greater detail herein.

Referring to FIG. 1 and FIGS. 2-6, additional details of the preferred embodiment seat extension tray 100 are as follows. The tray 100 defines a first end 110 and a second end 120, opposite from the first end 110. The length dimension of the tray 100 extends between the ends 110 and 120. Extending between the ends 110 and 120 are a first face 130 and an oppositely directed second face 140. During use of the seat extension tray, the first face 130 is preferably directed upwards and the second face 140 is directed downwards. As such, the second face 140 contacts the seat surfaces 22 and 32 of the front driver seat 20 and the front passenger seat 30, respectively. The first face 130 is periodically referred to herein as a top face 130. And, the second face 140 is periodically referred to as a bottom face 140. The seat extension tray 100 also defines a forward face 150 and an oppositely directed rear face 160. The faces 150 and 160 extend between the top and bottom faces 130 and 140, respectively.

Referring further to FIGS. 2-6, additional aspects of the preferred seat extension tray 100 are illustrated. Preferably, one or more recessed receiving region(s) 132 are defined along the first face 130. The function of these receiving region (s) is described later herein. Preferably, one or more recessed receiving region(s) 142 are defined along the second face 140 of the seat extension tray 100. Most preferably, the recessed receiving region(s) 142 of the tray 100 are sized, shaped, and located along the second face 140 such that the regions 142 matingly contact or engage upwardly projecting lateral support members 24 and 34 of the front driver seat and front passenger seat 20, 30, respectively. This preferred configuration and orientation of the tray 100 with respect to the seats 20, 30 is shown in FIG. 1. Representative recessed receiving region(s) or channels corresponding to the regions 132 and 142 are shown in FIGS. 2-6. It will be appreciated that the present invention includes a wide range of sizes, shapes, and locations for the regions 132 and 142. Primarily, these factors are determined by the style and configuration of the seats 20, 30, and their orientation on the pallet 40.

Figure 7:
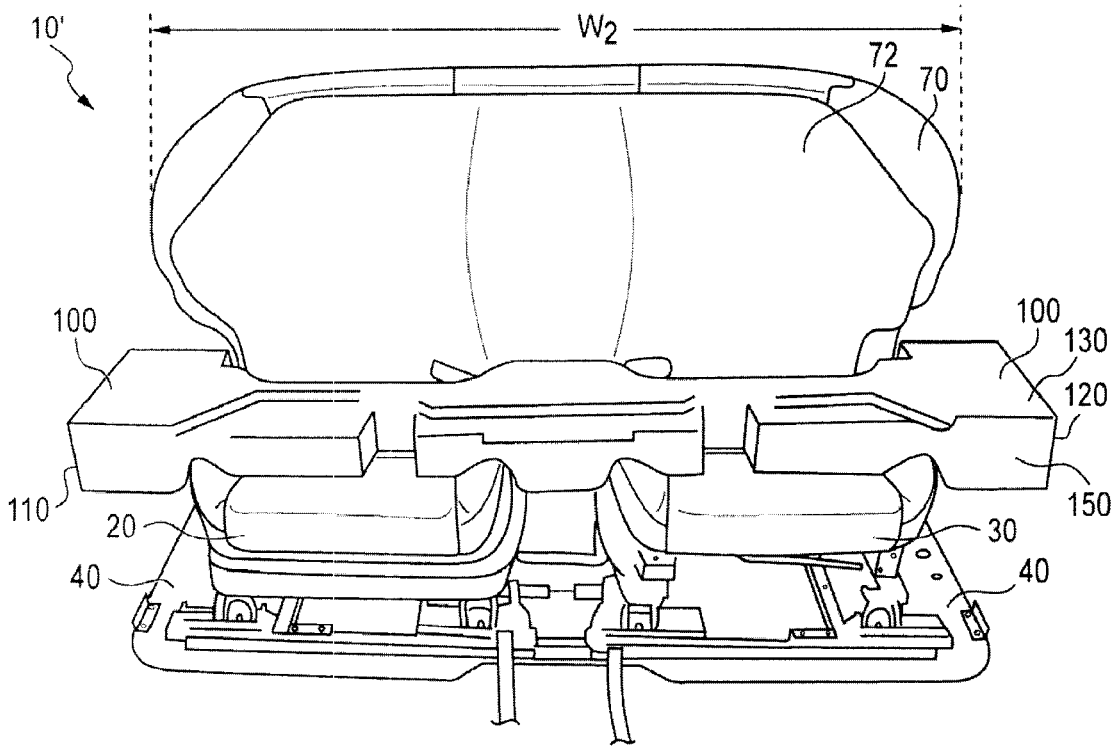
FIG. 7 is a front view of a representative collection of seat assemblies and a seat extension tray in accordance with the present invention during preparation for shipment.
Figure 8:
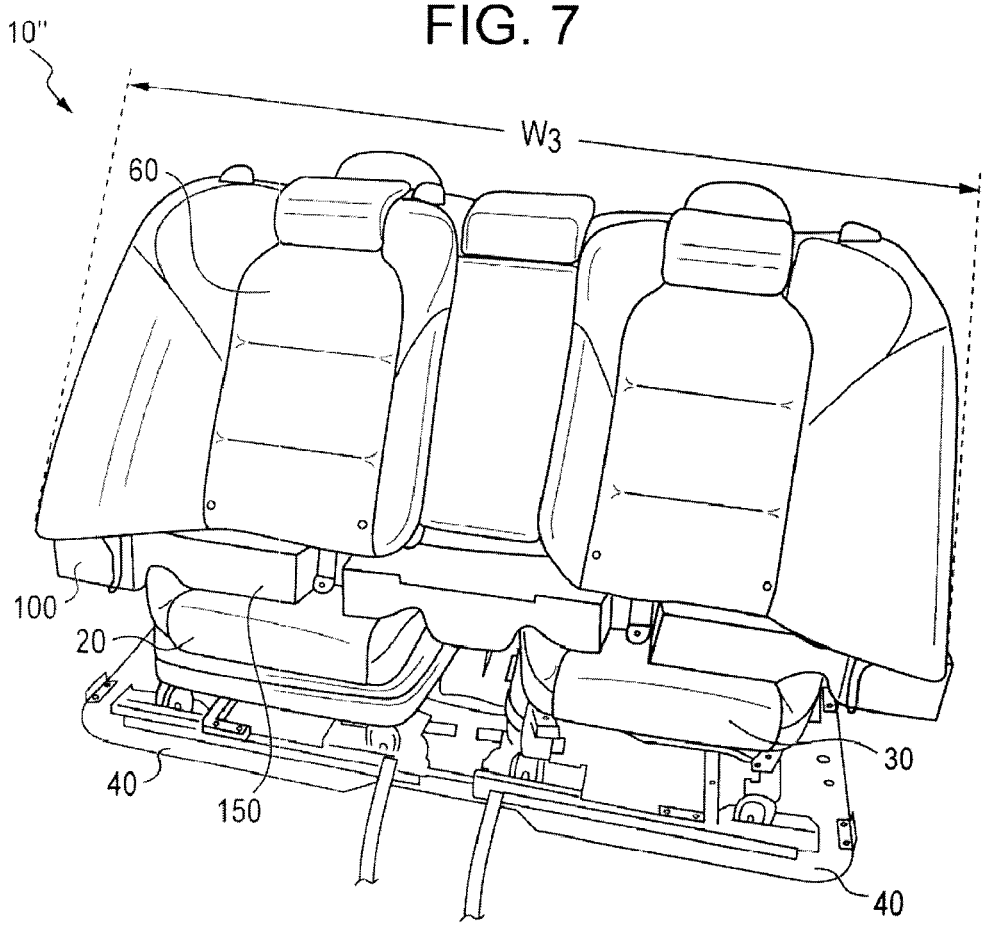
FIG. 8 is a front view of the assembly shown in FIG. 7 after incorporation of additional seating components in the assembly.
Figure 9:
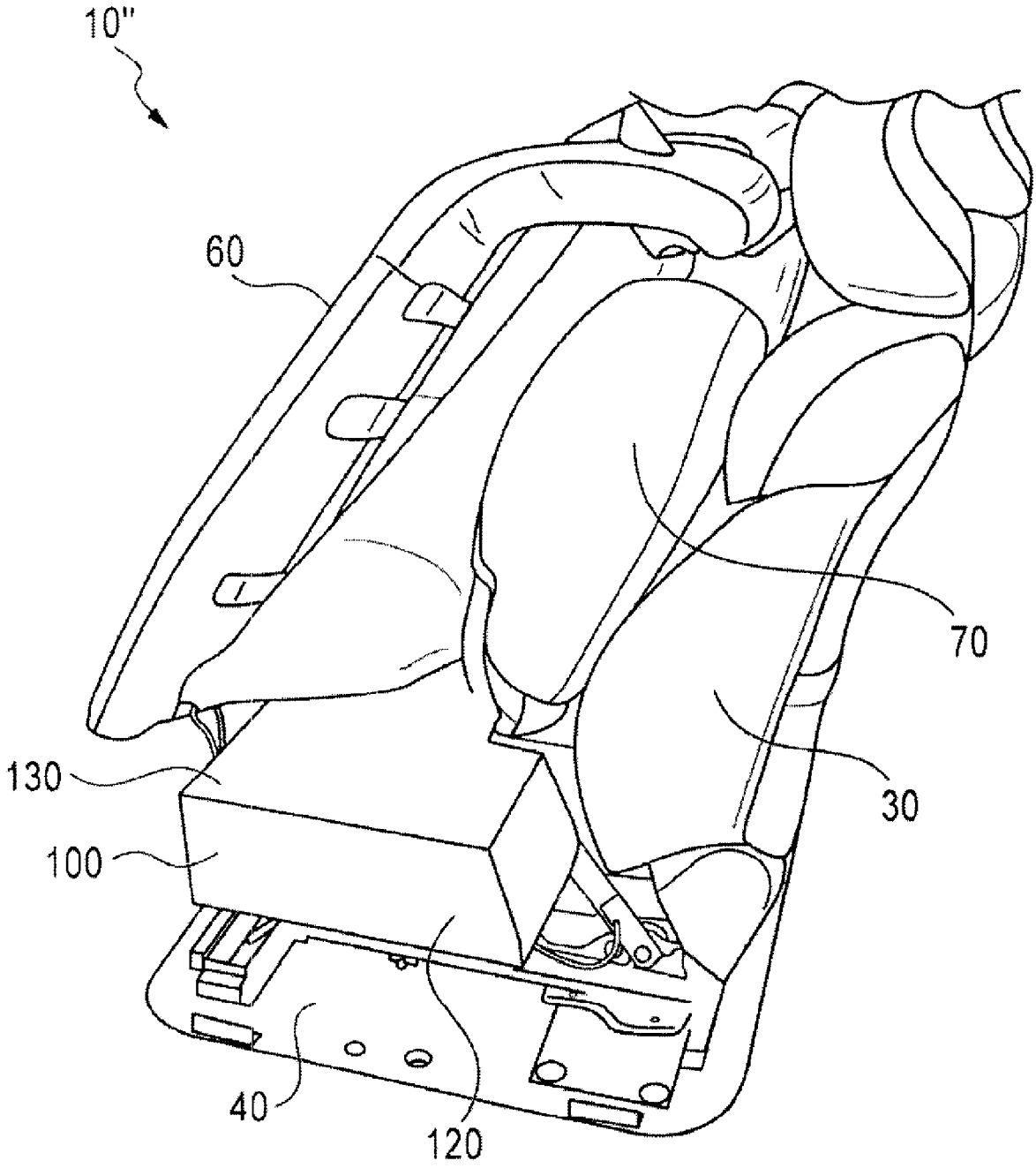
FIG. 9 is a side view of the assembly depicted in FIG. 8.

FIGS. 7-9 illustrate additional versions of seat shipping assemblies in accordance with the present invention, all of which utilize a seat extension tray. FIG. 7 illustrates the seat shipping assembly 10 of FIG. 1 further comprising a rear dual seat cushion member 70 disposed at least partially on the tray 100. This assembly is designated as a seat shipping assembly 10'. The rear seat cushion member 70 is oriented such that its underside 72 is generally facing the same direction as the forward face 150 of the tray 100. FIGS. 8 and 9 illustrate the assembly 10' of FIG. 7 further including a rear dual seat back member 60. The back member 60 is preferably positioned such that it is at least partially disposed on the tray 100. This assembly is designated as 10" and shown in FIGS. 8 and 9. FIGS. 8 and 9 depict a seat shipping assembly that includes seating components for four seats in a vehicle. The assembly may be bundled or otherwise secured to the pallet by one or more straps (not shown). FIG. 9 illustrates a side view of the assembly of FIG. 8 to better illustrate the orientation of the seat components and the seat extension tray.

Referring to FIGS. 1, 7, and 8, various preferred dimensional relationships are further described as follows. As previously noted, the length dimension of the seat extension tray 100 is defined herein as the linear distance between the ends 110 and 120. That distance is taken parallel with the longitudinal axis of the tray 100. For ease in convenience, that length dimension is depicted in FIG. 1 as L. The maximum width of the seat pallet 40 is denoted herein as $W_p$ and is illustrated in FIG. 1. The width of the seat pallet is the dimension of the pallet extending generally parallel with the width of the seat assemblies. The maximum width of the assembly of front driver seat 20 and front passenger seat 30 is denoted herein as $W_1$ and is shown in FIG. 1. As noted, seat shipping assemblies may contain additional seats such as assemblies 10' and 10". The maximum width of the rear seat cushion 70 is denoted as $W_2$ and shown in FIG. 7. And, the maximum width of the rear seat back 60 is denoted as $W_3$ and is illustrated in FIG. 8.

In accordance with the present invention, it is preferred that $L>W_p$. It is also preferred that $L>W_1$, $W_2$, and/or $W_3$. It is most preferred that $L>W_p$, $W_1$, $W_2$ and $W_3$. And, as noted, it is most preferred that L be greater than the largest of $W_p$, $W_1$, $W_2$, and $W_3$ by at least 10 mm. Although not wishing to be bound or limited to any particular size or length, it is contemplated that for many applications, a preferred length for the seat extension tray is at least 1200 mm, more preferably at least 1300 mm, more preferably at least 1400 mm, and most preferably at least 1500 mm. In a particularly preferred version, the seat extension tray is 1531 mm in length.

It is contemplated that in many instances, the seat extension tray may be reusable. That is, the seat extension tray is preferably formed from durable and resilient materials. It is also preferred that if formed from foamed material, that the tray be formed to have a relatively smooth outer skin.

It is also contemplated that the seat extension tray may include one or more ancillary components such as labels or other identifying components or indicia, RFID tags, and the like.

Furthermore, the present invention includes the use of two or more seat extension trays. Depending upon the particular orientation of seats relative to a shipping pallet, it may be desirable to use multiple seat extension trays arranged on or about one or more seats to protect the seats during shipment. Related to this, it is also contemplated that the seat extension tray(s) can be oriented in other arrangements relative to the seat(s) and the pallet. For example, it is contemplated that the seat extension tray could be used and configured to protect seat assemblies on pallets in other directions besides a width direction as generally described herein. For instance, one or more seat extension trays could be oriented at a 90° angle relative to the orientation of the tray shown in FIG. 1.

The seat extension trays are preferably free from permanent attachment to the shipping pallets. This feature enables the trays to be re-used with nearly any similar pallet, and simplifies packing and assembly of a seat shipping assembly.

Many other benefits will no doubt become apparent from future application and development of this technology.

All patents, published applications, and articles noted herein are hereby incorporated by reference in their entirety.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. An assembly of vehicle seat components adapted for shipping, the assembly comprising:

a seat pallet base, the seat pallet base defining a width dimension;

a seat assembly releasably secured to the seat pallet base, the seat assembly defining a seat assembly base disposed on the seat pallet base and a seating surface supported by the seat assembly base, the seat assembly defining a width dimension; and a seat extension tray disposed on the seat assembly, the seat extension tray defining a first end and a second end opposite from the first end, and a length dimension, which is a longest dimension of the seat extension tray, extending between the first end and the second end of the seat extension tray;

wherein the length dimension of the seat extension tray is greater than and parallel to the width dimension of the seat assembly, wherein the length dimension of the seat extension tray is greater than and parallel to the width dimension of the seat pallet base.

2. The assembly of claim 1 wherein the seat extension tray is disposed on the seating surface of the seat assembly.

3. The assembly of claim 1 wherein the seat extension tray is symmetrically disposed on the seat assembly.

4. The assembly of claim 1 wherein the length dimension of the seat extension tray is at least 10 mm greater than the width of the seat assembly.

5. The assembly of claim 1 wherein the seat assembly includes a driver front seat and a passenger front seat.

6. The assembly of claim 5 further comprising a second seat assembly disposed on the seat extension tray.

7. The assembly of claim 6 wherein the second seat assembly includes a rear seat assembly.

8. The assembly of claim 1 wherein the seat extension tray defines a first face and a second oppositely directed face, the first face defining at least one recessed region configured to receive and contact the seating surface of the seat assembly.

9. The assembly of claim 8 wherein the second face of the seat extension tray defines at least one recessed region configured to receive and contact another seat assembly.

10. The assembly of claim 1 wherein the seat extension tray comprises an expanded cellular polymeric material.

11. The assembly of claim 10 wherein the expanded cellular polymeric material is polypropylene foam.

12. A seat extension tray adapted for protecting a vehicle seat assembly during shipment, the seat extension tray defining:

a first end;

a second end opposite the first end, a length dimension extending between the first end and the second end of the seat extension tray;

a first face extending between the first end and the second end, the first face defining at least one recessed region;

wherein the at least one recessed region is configured to receive and matingly contact the upper surface of a vehicle seat assembly and the length dimension of the seat extension tray extends beyond the at least one recessed region, wherein the seat extension tray further defines a second face extending between the first end and the second end, the second face oppositely directed from the first face, the second face configured to receive and matingly contact with the lower surface of another such vehicle seat assembly.

13. The seat extension tray of claim 12 wherein the seat extension tray is formed from an expanded cellular polymeric material.

14. The seat extension tray of claim 12 in combination with a seat pallet base, wherein the seat pallet base defines a width dimension, wherein the length dimension of the seat extension tray is greater than the width dimension of the seat pallet base.

15. An assembly of vehicle seat components adapted for shipping, the assembly comprising:

a seat pallet base, the seat pallet base defining a width dimension;

a seat assembly including first and second seats each releasably secured to the seat pallet base, each seat defining a seat base disposed on the seat pallet base and a seating surface supported by the seat base, the seat assembly defining a maximum width dimension; and a seat extension tray disposed on the first and second seats of the seat assembly, the seat extension tray defining a first end and a second end opposite from the first end, and a length dimension, which is a longest dimension of the seat extension tray, extending between the first end and the second end of the seat extension tray;

wherein the length dimension of the seat extension tray is greater than and parallel to the maximum width dimension of the seat assembly.

16. The assembly of claim 15 wherein the length dimension of the seat extension tray is greater than and parallel to the width dimension of the seat pallet base.

17. The assembly of claim 15 wherein the seat extension tray defines a first face and a second oppositely directed face, the first face defining at least one recessed region configured to receive and contact each seating surface of the seats.

18. The assembly of claim 17 wherein the second face of the seat extension tray defines at least one recessed region configured to receive and contact an underside of a rear cushion member or another seat assembly.

* * * * *